US005708948A

United States Patent [19]

Chen et al.

[11] Patent Number: 5,708,948

[45] Date of Patent: Jan. 13, 1998

[54] FUSER BELTS WITH IMPROVED RELEASE AND GLOSS

[75] Inventors: Jiann-H. Chen, Fairport; Muhammed Aslam; Lawrence Paul Demejo, both of Rochester, all of N.Y.

[73] Assignee: Eastman Kodak Company, Rochester, N.Y.

[21] Appl. No.: 691,621

[22] Filed: Aug. 2, 1996

[51] Int. Cl.[6] ..... G03G 15/20

[52] U.S. Cl. ..... 399/329; 430/99; 430/124

[58] Field of Search ..... 399/329, 333; 428/447; 430/99, 124

[56] References Cited

U.S. PATENT DOCUMENTS

| | | | |
|---|---|---|---|
| 5,089,363 | 2/1992 | Rimai et al. | 430/45 |
| 5,124,755 | 6/1992 | Hediger | 355/285 |
| 5,153,656 | 10/1992 | Johnson et al. | 399/329 X |
| 5,200,284 | 4/1993 | Chen et al. | 430/33 |
| 5,233,008 | 8/1993 | Chen et al. | 528/33 |
| 5,258,256 | 11/1993 | Aslam et al. | 430/124 |
| 5,330,840 | 7/1994 | Chen et al. | 428/423.1 |
| 5,362,833 | 11/1994 | Chen et al. | 528/25 |
| 5,386,281 | 1/1995 | Mitani et al. | 355/190 |
| 5,465,146 | 11/1995 | Higashi et al. | 355/285 |
| 5,529,847 | 6/1996 | Chen et al. | 428/413 |

*Primary Examiner*—Nestor R. Ramirez

[57] ABSTRACT

This invention provides a fuser belt comprising a substrate and a coating on said substrate, said coating comprises a resin made by curing a composition comprising siloxanes having a ratio of difunctional to trifunctional units of 1:1 to 1:2.7 and at least 90% of total number of functional units in said siloxanes are difunctional and trifunctional units, a weight average molecular weight of 5,000 to 50,000 grams/mole, and an alkyl to aryl ratio of 1:0.1 to 1:1.2.

20 Claims, 1 Drawing Sheet

FUSER BELTS WITH IMPROVED RELEASE AND GLOSS

FIELD OF THE INVENTION

This invention relates to a fuser belt useful for heat-fixing a heat-softenable toner material to a receiver. More particularly, this invention relates to a fuser belt with improved release that provides fused toner images having high gloss.

BACKGROUND OF THE INVENTION

Electrophotography can be used to create photographic quality multicolor toner images when the toner particles are small, that is, less than about 10 micrometers, and the receivers, typically papers, are smooth. Electrophotography typically involves the steps of charging a photoconductive element, exposing the photoconductive or dielectric element to create an electrostatic image, toning the electrostatic image, transferring the toner to a receiver, and fixing the toner to the receiver. A typical method of making a multicolor toner image involves trichromatic color synthesis by subtractive color formation. In such synthesis successive imagewise electrostatic images are formed on an element, each representing a different color, and each image is developed with a toner of a different color. Typically, the colors will correspond to each of the three primary colors (cyan, magenta and yellow) and black, if desired. The imagewise electrostatic images for each of the colors can be made succesively on a photoconductive element by using filters for each color separation to reflect only the light corresponding to each color in the image to the photoconductive element. After developing each color separation, it can be transferred from the photoconductive element successively in registration with the other color toner images to an intermediate transfer member and then all the color toner images can be transferred in one step from the intermediate transfer member to a receiver. After all the color toners have been transferred to the receiver, the toners are fixed or fused to the receiver. To match the photographic quality produced using silver halide technology, it is preferred that these multicolor toner images have high gloss.

U.S. Pat. No. 5,258,256 discloses that toners having specified viscoelastic flow characteristics, as evidenced by a loss tangent of at least 1.2, used in a belt fusing system can provide desirable gloss. The belt in the belt fusing system can be made of stainless steel or polyester and the outer surface of the fuser member can be aluminum, steel, various alloys, or polymeric materials, such as, thermoset resins and fluoroelastomers. Further, release agents may be used on the fuser belt.

The background art discloses several broad classes of materials useful for fuser belts. For example, U.S. Pat. Nos. 5,089,363; 5,465,146; 5,386,281; 5,362,833; 5,529,847; 5,330,840; 5,233,008; 5,200,284 and 5,124,755 disclose fuser belt systems consisting of belts coated with silicone polymers. U.S. Pat. No. 5,089,363 discloses that metal belts coated with highly crosslinked polysiloxanes provide fused toner images having high gloss.

There is still a need for fuser belts which provide high gloss, longlife, and good release of the fused toner images.

SUMMARY OF THE INVENTION

The present invention provides a fuser belt comprising a substrate and a coating on said substrate, said coating comprises a resin made by curing a composition comprising siloxanes having a ratio of difunctional to trifunctional units of 1:1 to 1:2.7 and at least 90% of total number of functional units of said siloxanes are difunctional and trifunctional units, a weight average molecular weight of 5,000 to 50,000, and an alkyl to aryl ratio of 1:0.1 to 1:1.2.

This fuser belt provides high gloss, long-life, and good release of the fused toner images. The life of the fuser belts is typically greater than 5,000 fused toner images.

DESCRIPTION OF THE INVENTION

Figure 1:
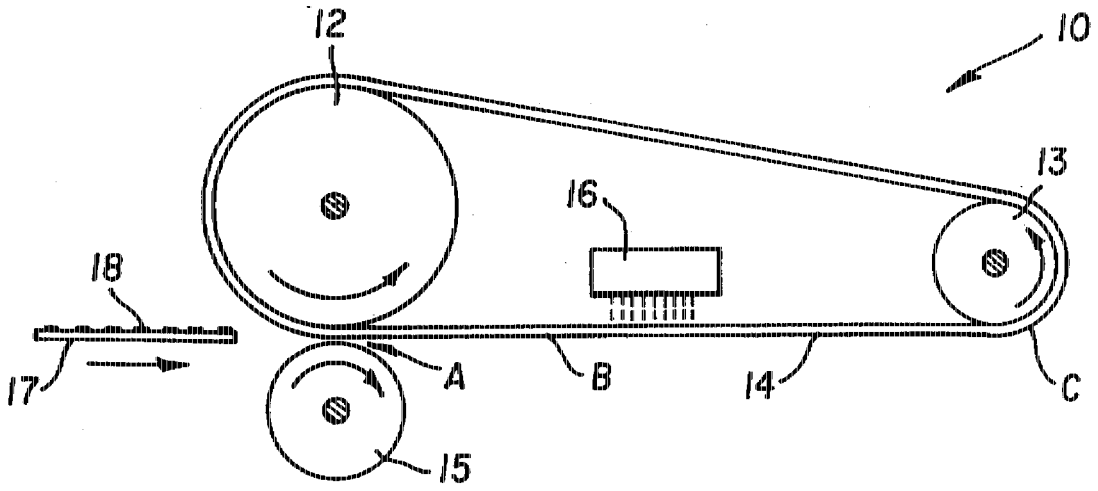
FIG. 1 shows a fuser belt of the invention in a fuser system.

The fuser belt of this invention comprises a substrate over which a coating comprising a silicone resin is coated. The substrate can comprise metal, such as, stainless steel, steel, nickel, copper, and chrome, or a polymer, such as, polyimide, polyester, polycarbonate, and polyamide, or mixtures or combinations of the listed materials. The substrate can be a smooth sheet or a meshed material, preferably it is a smooth sheet. The substrate is preferably a seamless endless belt; however, belts having seams can also be used. The thickness of the substrate is preferably 50 to 200 micrometers, more preferably 50 to 100 micrometers and most preferably 50 to 75 micrometers.

The silicone resins in the coating on the substrate can comprise monofunctional, difunctional, trifunctional and tetrafunctional units or units having mixtures of these functionalities. Monofunctional units can be represented by the formula $—(R)_3SiO_{0.5}—$. Difunctional units can be represented by the formula $—(R)_2SiO—$. Trifunctional units can be represented by the formula $—(R)SiO_{0.5}—$. Tetrafunctional units can be represented by the formula $—SiO_2—$. R in the formulas independently represents alkyl groups preferably having from 1 to 8 carbons, more preferably 1 to 5 carbons or aryl groups preferably having 4 to 10 carbons in the ring(s), more preferably 6 carbons in the ring(s). The siloxanes used to form the silicone resin comprise at least some R groups which are alkyl groups, and some R groups which are aryl groups. Mixtures of different alkyl groups and different aryl groups may be present in the siloxanes. The alkyl and all groups can comprise additional substituents and heteroatoms, such as, halogens, in for example a fluoropropyl group, and alkyl groups, in for example a methylphenyl group. The alkyl groups are preferably methyl, ethyl, propyl, isopropyl, butyl, isobutyl, tert-butyl, pentyl, more preferably methyl, ethyl, propyl, and isopropyl, most preferably methyl. The aryl groups are preferably phenyl, diphenyl, or benzyl, more preferably phenyl. The silicone resins have an alkyl to aryl ratio of 1:0.1 to 1:1.2; more preferably 1:0.3 to 1:1.0; most preferably 1:0.4 to 1:0.9. The silicone resin has a ratio of difunctional to trifunctional units of 1:1 to 1:2.7, more preferably 1:1.5 to 1:2.5, most preferably 1:1.8 to 1:2.3 and at least 90% of total number of functional units in the silicone resin are difunctional and trifunctional units, more preferably at least 95% of total number of functional units in the silicone resin are difunctional and trifunctional units, most preferably at least 98% of total number of functional units in the silicone resin are difunctional and trifunctional units. The preferred silicone resins comprise substantially only difunctional, trifunctional and tetrafunctional units, meaning that the preferred silicone resins comprise less than 1% monofunctional units of the total number of functional units in the silicone resin. The most preferred silicone resins comprise substantially only difunctional and trifunctional units, meaning that the most preferred silicone resins comprise less than 1% monofunctional and tetrafunctional units of total number of functional units in the silicone resin. The percentages of the functionalities in the silicone resin can be determined using $Si^{29}$ NMR.

The silicone resin is made by curing a composition comprising siloxanes. Siloxanes can be monofunctional, difunctional, trifunctional and/or tetrafunctional silicone polymers. The siloxanes are preferably hydroxy-terminated silicone polymers or have at least two hydroxy groups per siloxane. The weight average molecular weight of the siloxanes used to make the thermoset silicone resin is preferably 5,000 to 50,000 grams/mole (g/mol), more preferably 6,000 to 30,000 g/mol, most preferably 7,500 to 15,000 g/mol. Even more preferred are siloxanes having a weight average molecular weight of 7,500 to 10,000 g/mol, and more preferably 7,500 to 8,500. The weight average molecular weight is determined by Size Exclusion Chromatography (SEC). Once the silicone resin is cured, typically by thermosciting, it is difficult to determine the weight average molecular weight of the siloxanes used to form the silicone resin; however, the functional units and alkyl to aryl ratio of the siloxanes will be the same for the silicone resin and the siloxanes used to make the silicone resin.

The silicone resin which is preferably highly crosslinked can be prepared as described in numerous publications. The silicone resins used in this invention are hard, brittle, and highly crosslinked, as compared to silicone elastomers which are deformable, elastic, and highly crosslinked. One method to form the silicone resin is by a condensation reaction as described in, for example, D. Sats, *Handbook of Pressure Sensitive Adhesive Technology,* 2nd Ed., pp. 601–609, Van Nostrand Reinhold (1989). Other references which disclose the preparation of these highly crosslinked silicone resins are Kirk-Othmer, *Encyclopedia of Chemical Technology,* 3rd Ed., Vol. 20, pp. 940–962; and Lichtenwalner and Sprung, Bikales, Ed., *Encyclopedia of Polymer Science and Technology,* Vol. 12, Interscience Publishers, (New York 1970) pg. 464. Useful silicone resins are commercially available, such as, DM 30036 and DM 30020 available from Acheson Colloids Company, and DC-2531 available from Dow Corning.

The fuser belt coating can comprise fillers. It is preferred that the fillers, if present are at an amount less than 3%, more preferably less than 1%, to maintain a smooth surface of the coating on the fuser belt. Examples of useful fillers include aluminum, silica, and copper. The preferred fuser belts of this invention have coatings which do not contain fillers, that is, they are non-filled coatings. The non-filled coatings are preferred, because typically they produce fused toner images having higher gloss.

The thickness of the silicone resin coating on the belt is preferably less than 50 micrometers, preferably 1 to 25 micrometers, most preferably 1 to 15 micrometers. Additional layers can be present on the fuser belt if desired.

It is preferred that the surface energy of the coating is 20 to 30 milliJoules/meter$^2$ or less, because low surface energy belts provide better release of toner without the addition of release oils. The fuser belt preferably provides a surface finish of the fused toner image of G-20 gloss greater than 70, preferably greater than 80, most preferably greater than 90. The highest gloss is achieved when smooth receivers, such as photographic papers, are used in conjunction with the fuser belts of this invention. The gloss measurements can be determined using a BYK Gardner micro glossmeter set at 20 degrees by the method described in ASTM-523-67.

The substrates of the fuser belts are preferably solvent cleaned prior to coating the substrates with the release coating. The release coatings are preferably prepared by making a solvent solution comprising the siloxanes and coating the solution onto the clean substrate by conventional coating techniques, such as, ring coating, dip coating, and spray coating. After coating the substrates with the release coating solution, the coated substrates are preferably placed in a convection oven at a temperature of 150° C. to 350° C., for 10 minutes to 3 hours, preferably causing the siloxanes to undergo condensation reactions to form the silicone resin. The higher the cure temperature the shorter the cure time.

It may be desirable to use primer, adhesion promoters or other layers between the substrate and the silicone resin coating of the fuser belt. For example, silane primers, and functionalized silane primers can be applied to the substrate, prior to the application of the release coating. Examples of commercially available primers are Dow Corning DC1200, and Petrarch A0700 and A0698.

Fuser belts of this invention can be any size and can be used in any fuser belt system which comprises a fuser belt. Preferably the fuser belt system comprises a fuser belt which is trained around two or more rollers, and is in pressurized contact with another fuser member, preferably either another fuser belt or a fuser roller. Fuser belts of this invention can be used to contact the toner-bearing or non-toner-bearing side of a receiver.

FIG. 1 illustrates the preferred configuration of a fuser belt system 10 using a fuser belt 14 of this invention. The fuser belt system 10 comprises a heating roller 12, and roller 13 around which fuser belt 14 is trained which is conveyed in the direction indicated on rollers 12 and 13 in FIG. 1. Backup roller 15 is biased against the heating roller 12. The fuser belt 14 is cooled by impinging air provided by blower 16 disposed above fuser belt 14. In operation, receiver 17 bearing the unfused toner 18 is transported in the direction of the arrow into the nip between heating roller 12 and backup roller 15, which can also or alternatively be heated if desired, where it enters a fusing zone A extending about 0.25 to 2.5 cm, preferably about 0.6 cm laterally along the fuser belt 14. Following fusing in the fusing zone A, the fused image then continues along the path of the belt 14 and into the cooling zone B about 5 to 50 cm in length in the region after the fusing zone A and to roller 13. In the cooling zone B, belt 14 is cooled slightly upon separation from heating roller 12 and then additionally cooled in a controlled manner by air that is caused to impinge upon belt 14 as the belt passes around roller 13 and is transported to copy collection means such as a tray (not shown). Support 17 bearing the fused image is separated from the fuser belt 14 within the release zone C at a temperature where no toner image offset occurs. Separation is expedited by using a roller 13 of relatively small diameter, e.g. a diameter of about 2.5 to 4 cm. As a result of passing through the three distinct zones, i.e. the fusing zone A, cooling zone B and release zone C, the fused toner image exhibits high gloss. The extent of each of the three zones and the duration of the time the toner image resides in each zone can be conveniently controlled simply by adjusting the velocity or speed of belt 14. The velocity of the belt in a specific situation will depend on several variables, including, for example, the temperature of the belt in the fusing zone A, the temperature of the cooling air in the cooling zone B, and the composition of the toner particles.

The invention will be better understood with reference to the following examples:

WORKING EXAMPLES

Example 1

A stainless steel belt 3 mil (75 micrometers) thick, 30 inch (76.2 cm) circumference, and 10 inch (25.4 cm) wide was coated with DC-2531 silicone thermoset resin by the following process.

The belt was wiped with dichloromethane followed by acetone and ethanol and then allowed to air dry. The belt was ting coated with a Dow Corning DC-1200 silane primer solution (20% solids) and air dried to a coating thickness of approximately 1.5 micrometers. Next, Dow Corning DC-2531, a thermoset silicone resin having phenyl and methyl groups, in solution (20% solids) was ring coated over the primer coating and air dried for 1 hour. The coating was cured in a forced air oven by ramping the temperature from ambient to 200° C. over a period of 30 minutes followed by a 1 hour curing period at 200° C. The DC-2531 highly crosslinked silicone resin had a dry coating thickness of approximately 1.5 micrometers. The Alkyl:Aryl Ratio, the difunctional to trifunctional ratio (D:T Ratio) and the weight average molecular weight (MW g/mol) of the siloxanes for DC-2531 are listed in Table 1. This belt was tested as described below and the results are in Table 1.

Examples 2–6

Five stainless steel belts having the same dimensions as the one described in Example 1 were coated with Acheson DM 30036 silicone thermoset resin.

The five belts were cleaned as described in Example 1 and ring coated with an Acheson Colloid DM 30036 solution (44% solids) diluted 2:1 with Naphtha. The belts were allowed to air dry and then were cured in a forced air oven by ramping the temperature from ambient to 200° C. over a period of 1 hour followed by a 2 hour curing period at 200° C. The DM-30036 highly crosslinked silicone resin had a dry coating thickness of approximately 1.5 micrometers. The Alkyl:Aryl Ratio, the D:T Ratio, and the weight average molecular weight of the siloxanes for DM-30036 are listed in Table 1. These belts were tested as described below and the results are in Table 1.

Testing Conditions for Examples 1 to 6

These fuser belts were mounted on a fuser system like the one shown in FIG. 1, and run at 115° C. to 138° C. fusing temperature and 35° C. to 46° C. release temperature against a Silastic J (available from Dow Corning Co.) coated pressure roller at a nip load of approximately 15 kg/cm. Fusing speed was 3.5 cm/sec to 4 cm/sec. The nip width was 0.6 cm. Blank sheets of Pliotone/Piccotex (70/30) coated paper were used with toned prints interspersed at 200 print intervals. The life tests were terminated when toner or receiver offset onto the belt surface, when localized areas of the belt coating delaminated or after 20,000 prints. The life test and image gloss results and the belt coating material properties are summarized in Table 1. The gloss measurements were made according to ASTM-523-67 using a BYK Gardener Micro Gloss Meter set at 20 degrees.

TABLE 1

| Example # | Alkyl:Aryl Ratio | D:T Ratio | MW (g/mole) | G-20 Gloss | Belt Life # of Prints |
|---|---|---|---|---|---|
| Example 1 | 1:0.4 | 1:2.3 | 7540 | 90–100 | 11,400 |
| Example 2 | 1:0.8 | 1:1.8 | 8200 | 90–100 | 13,700 |
| Example 3 | 1:0.8 | 1:1.8 | 8200 | 90–100 | 20,000+ |
| Example 4 | 1:0.8 | 1:1.8 | 8200 | 90–100 | 12,800 |
| Example 5 | 1:0.8 | 1:1.8 | 8200 | 90–100 | 20,000+ |
| Example 6 | 1:0.8 | 1:1.8 | 8200 | 90–100 | 8,400 |

Examples 7 to 9

Three stainless steel belts, 75 micrometers, 44 cm in circumference and 25.4 cm wide, were cleaned and coated with Dow Corning DC-1200 primer, and Dow Corning DC-2531 highly crosslinked silicone thermoset resin in the manner described in Example 1. The Alkyl:Aryl Ratio, D:T Ratio, and the weight average molecular weight of the siloxane units for DC-2531 are listed in Table 2. These belts were tested as described below and the results are in Table 2.

Examples 10 to 12

Three stainless steel belts, 75 micometers, 44 cm in circumference and 25.4 cm wide, after cleaning as described in Example 1, were coated with an Acheson Colloid DM 30020 solution (44% solids with 1% aluminum particles) diluted 2:1 with Naphtha. Acheson Colloid DM 30020 is a thermoset silicone resin. The belts were allowed to air dry and then were cured in a forced air oven by ramping the temperature from ambient to 200° C. over a period of 1 hour followed by a 2 hour curing period at 200° C. The DM 30020, highly crosslinked silicone resin had a dry coating thickness of approximately 1.5 micrometers. The Alkyl:Aryl Ratio, D:T Ratio, and the weight average molecular weight of the siloxane units for DC 30020 are listed in Table 2. These belts were tested as described below and the results are in Table 2.

Examples 13 and 14

Two stainless steel belts, 75 micrometers, 44 cm in circumference and 25.4 cm wide, after cleaning as described in Example 1, were coated with an Acheson Colloid DM 30020 solution (44% solids with 1% aluminum particles) after the aluminum particles were filtered out of the solution and the solution was diluted 2:1 with Naphtha. The same drying and curing conditions used for Examples 10 to 12 were repeated. The filtered DM 30020 highly crosslinked thermoset silicone resin dry coating thickness was approximately 1.5 micrometers. The Alkyl:Aryl Ratio, the D:T Ratio, and the weight average molecular weight of the siloxane units for the filtered DM 30020 are listed in Table 2. These belts were tested as described below and the results are in Table 2.

Comparative Example 1 and 2

Two belts which were the same as those described in Examples 7–9 were cleaned and ring-coated with an epoxy silicone. The epoxy silicone was prepared by mixing 50 grams of toluene, 100 grams of PS-123, 50 grams allyl glycidyl ether, and 0.45 grams of PC-075, a platinum catalyst sold by Huls America Inc., at room temperature until all allyl and silane groups were consumed (monitored by NMR and IR spectra). PS-123 is a copolymer of methylhydro/dimethylpolysiloxane containing about 30 mole percent methylhydro sold by Huts America Inc. The mixture was dried to give epoxy-functionalized polydimethylsiloxane. Then the epoxy-functionalized polydimethylsiloxane was dissolved in 80 grams of tetrahydrofuran in the presence of 11.26 grams of hexahydrophthalic anhydride, then 0.58 grams of dimethylbenzylamine and 34.08 grams of DC6-2230 hard silicone resin from Dow Corning were added to the solution. This mixture was ring coated onto the belts and cured in a convective oven at 100° C. for 2 hours and 150° C. for 4 hours to produce a highly crosslinked thermoset silicone resin. The Alkyl:Aryl Ratio, the D:T Ratio, and the weight average molecular weight of the siloxane units for this highly crosslinked epoxy silicone resin are listed in Table 2. These belts were tested as described below and the results are in Table 2.

Comparative Example 3

Comparative Example 1 was repeated except that the coating solution consisted of a 1:1 mixture by weight of solids of the coating solution of Comparative Example 2 and PR6155 silsesquioxane ($RSiO_{1.5}$ where R is methyl) available from Huts America Inc. This resulted in a fuser belt coated with a highly crosslinked thermoset silicone resin. The Alkyl:Aryl Ratio, the D:T Ratio, and the weight average molecular weight of the siloxane units are listed in Table 2. This belt was tested as described below and the results are in Table 2.

Comparative Example 4

2-allylphenol (60 grams), toluene (50 g) and PS 123 (100 g) were mixed with PC-075 (0.48 g) for 3 hours. (PS-123 and PC-075 were described in Comparative Examples 1 and 2.) The toluene was removed in a rotary evaporator at 55° C. to give the phenolic polydimethylsiloxane. 14.4 grams of the phenolic polydimethylsiloxane, 3.6 grams of Cymel-380 melamine resin (which is a hexamethoxymethylamine from American Cyanimid), 7.2 grams of DC-6-2330 available from Dow Corning Co. and 0.42 grams of trifluoroacetic acid were disolved in 72 grams of methylethyl ketone and coated on a cleaned belt as described in Examples 1--6 and was then heat-cured in an oven at 160° C. for 2 hours, producing a highly crosslinked thermoset silicone resin. The Alkyl:Aryl Ratio, the D:T Ratio, and the weight average molecular weight of the siloxanes for this silicone resin are listed in Table 2. This belt was tested as described below and the results are in Table 2.

Comparative Example 5

The same belt described in Examples 1--6 was cleaned and ring-coated with a DC-806A solution consisting of 50% by weight DC-806A and 17% by weight toluene and 33% by weight xylene. DC-806A is characterized as silanol-terminated polymethyl-phenyl siloxane copolymer containing phenyl and methyl groups. The coated belt was then cured at 232° C. for 60 minutes giving a 0.5 mil thick layer of DC-806A, highly crosslinked thermoset silicone resin. The Alkyl:Aryl Ratio, the D:T Ratio, and the weight average molecular weight of the siloxane units for DC-806A are listed in Table 2. This belt was tested as described below and the results are in Table 2.

Testing Conditions for Examples 7 to 14 and Comparative Examples 1 to 5

These fusing belts were mounted on the similar life test breadboard as described above for Examples 1 to 6. The fusing temperatures ranged from 113° C. to 127° C. and release temperatures ranged from 41° C. to 60° C. The life tests and gloss were determined as described above.

TABLE 2

| Example # | Alkyl:Aryl Ratio | D:T Ratio | MW (g/mole) | G-20 Gloss | Belt Life # of Prints |
|---|---|---|---|---|---|
| Example 7 | 1:0.4 | 1:2.3 | 7540 | 90--100 | 2420 |
| Example 8 | 1:0.4 | 1:2.3 | 7540 | 90--100 | 5947 |
| Example 9 | 1:0.4 | 1:2.3 | 7540 | 90--100 | 5173 |
| Example 10 | 1:0.9 | 1:1.8 | 8200 | 59 | 7200 |
| Example 11 | 1:0.9 | 1:1.8 | 8200 | 59 | 3412 |
| Example 12 | 1:0.9 | 1:1.8 | 8200 | 59 | 5000 |
| Example 13 | 1:0.9 | 1:1.8 | 8200 | 90--100 | 10,025 |
| Example 14 | 1:0.9 | 1:1.8 | 8200 | 90--100 | 15,674 |
| Comp. Ex. 1 | 1:0.37 | 1:0.82 | 2000--4000 | ---- | 3433 |
| Comp. Ex. 2 | 1:0.37 | 1:0.82 | 2000--4000 | ---- | 3350 |

TABLE 2-continued

| Example # | Alkyl:Aryl Ratio | D:T Ratio | MW (g/mole) | G-20 Gloss | Belt Life # of Prints |
|---|---|---|---|---|---|
| Comp. Ex. 3 | 1:0.21 | 1:2.64 | 2000--4000 | 30 | 1900 |
| Comp. Ex. 4 | 1:0.36 | 1:0.43 | 2000--4000 | 59 | 1500 |
| Comp. Ex. 5 | 1:1 | 1:2 | 200,000--400,000 | 30 | 500 |

Comparative Example 6

A belt as described in Examples 1 to 6 was cleaned, coated with a silicone primer GE4044, available from General Electric, air dried and ring coated with EC-4952 available from Emerson Cumming Co. EC-4952 is an condensation cured silanol-terminated polymethylsiloxane having only methyl groups on mostly difunctional units, which is a highly crosslinked silicone elastomer. The belt was cured for 24 hours at room temperature and postcured for 12 hours at 210° C. in a convection oven. The final coating of EC-4952 was 25 micrometers thick. The Alkyl:Aryl Ratio, the D:T Ratio, and the weight average molecular weight of the siloxanes for EC-4952 are listed in Table 3. This belt was tested as described below and the results are in Table 3.

Comparative Example 7

A belt as described in Examples 1 to 6 was cleaned, ring coated with SILASTIC J available from Dow Corning Co. by following the instructions provided by Dow, cured for 4 hours ramp to 205° C. and 12 hours at 205° C. in a convection oven. SILASTIC J is a vinyl and silane functionalized addition-cured polymethylsiloxane, which is a highly crosslinked silicone elastomer. The final thickness of the SILASTIC J was 3 micrometers. The Alkyl:Aryl Ratio, the D:T Ratio, and the weight average molecular weight of the siloxane units for DC-2531 are listed in Table 3. This belt was tested and the results are in Table 3.

Testing Conditions for Comparative Examples 6 and 7

The fuser belt tests were conducted and run in the same setup indicated for Examples 1 to 6 except that the life tests were not conducted. A gloss measurement was taken after a few copies were made. The results of this test are in Table 3. The Life Tests were not performed, because the gloss was low for both Comparative Examples 6 and 7.

TABLE 3

| Example # | Alkyl:Aryl Ratio | D:T Ratio | Mw (g/mole) | G-20 Gloss |
|---|---|---|---|---|
| Comp. Ex. 6 | 0:100 | 1:0.176 | 71,000 | 0.5 |
| Comp. Ex. 7 | 0:100 | 1:0.341 | 108,000 | 3 |

Comparative Example 8

A "2F" finish stainless steel shim stock, available from Teledyne Rodney Metals, was cleaned and hand-coated with a DC-805 solution (50% by weight in xylene) available from Dow Corning Co. DC-805 is a silanol-terminated polymethyl-phenyl siloxane copolymer containing methyl and phenyl groups. The coated shim stock was then cured at 232° C. for 60 minutes. The resulting DC-805 highly crosslinked thermoset silicone resin coating was 5 micrometers thick. The Alkyl:Aryl Ratio, the D:T Ratio, and the weight average molecular weight of the siloxanes for DC-805 are listed in Table 4. This coating on the shim stock was tested as described below and the results are in Table 4.

Comparative Example 9

Comparative Example 8 was repeated except that DC6-2230 available from Dow Corning Co. was coated on a shim stock using a DC6-2230 solution which was 50% by weight solids in tetrahydrofuran. DC6-2230 is a silanol terminated polymethyl-phenyl siloxane copolymer containing methyl and phenyl groups. The shim stock was then cured at 218° C. for 60 minutes producing a highly crosslinked silicone resin coating. The Alkyl:Aryl Ratio, the D:T Ratio, and the weight average molecular weight of the siloxane units for DC6-2230 are listed in Table 4. The coating on the shim stock was tested as described below and the results are in Table 4.

Testing Conditions for Comparative Examples 8 and 9

A gloss measurement for Comparative Examples 8 and 9 was taken by using a heated aluminum hard roller and a soft 0.5 mm red rubber coated pressure roller fuser setup. The print with the toner image side against the shim stock was passed through the nip at 3.8 cm per second. Heat was supplied to the image from the heated roller through the shim stock. Prints were allowed to cool and then separated from the steel. The test results are given in Table 4.

TABLE 4

| Example # | Alkyl:Aryl Ratio | D:T Ratio | Mw (g/mole) | G-20 Gloss |
|---|---|---|---|---|
| Comp. Ex. 8 | 1:1 | 1:0.83 | 200,000 to 400,000 | 43 |
| Comp. Ex. 9 | 1:1 | 1:9 | 2,000 to 4,000 | 30 |

These Examples and Comparative Examples illustrate the benefits of this invention. Examples 1–14 indicate that the fuser belts having the silicone resin coatings of the invention have long life and produce toner images having high gloss. Comparative Examples 1 to 5 which are silicone resin coatings outside of the scope of the invention have shorter life and/or produce toner images having lower gloss. Comparative Examples 6 and 7 are highly crosslinked silicone elastomers which produce toner images having low gloss. Comparative Examples 8 and 9 are silicone resins which are outside of the scope of the invention and produce toner images having low gloss.

The invention has been described with reference to particular embodiments, but it is appreciated that variations and modifications can be effected within the spirit and scope of the invention.

We claim:

1. A fuser belt comprising a substrate and a coating on said substrate, said coating comprises a resin made by curing a composition comprising siloxanes having a ratio of difunctional to trifunctional units of 1:1 to 1:2.7 and at least 90% of total number of functional units in said siloxanes are difunctional and trifunctional units, a weight average molecular weight of 5,000 to 50,000 grams/mole, and an alkyl to aryl ratio of 1:0.1 to 1:1.2.

2. A fuser belt of claim 1 wherein said ratio of difunctional to trifunctional units is 1:1.5 to 1:2.5.

3. A fuser belt of claim 1 wherein said ratio of difunctional to trifunctional units is 1:1.8 to 1:2.3.

4. A fuser belt of claim 1 wherein said alkyl to aryl ratio is 1:0.3 to 1:1.0.

5. A fuser belt of claim 1 wherein said alkyl to aryl ratio is 1:0.4 to 1:0.9.

6. A fuser belt of claim 1 wherein said weight average molecular weight is 6,000 to 30,000 grams/mole.

7. A fuser belt of claim 1 wherein said weight average molecular weight is 7,500 to 15,000 grams/mole.

8. A fuser belt of claim 1 wherein said alkyl groups are methyl and said aryl groups are phenyl.

9. A fuser belt of claim 1 wherein said siloxanes are hydroxy-terminated.

10. A fuser belt of claim 1 which produces fused toner images having a G-20 gloss of greater than 70.

11. A fuser belt of claim 1 having a surface energy of 20 to 30 milliJoules/meter$^2$.

12. A fuser belt of claim 1 wherein said siloxanes comprise less than 1% monofunctional units of total number of functional units in said siloxanes.

13. A fuser belt of claim 1 wherein said siloxanes comprise less than 1% monofunctional and tetrafunctional units of total number of functional units in said siloxanes.

14. A fuser belt of claim 1 wherein said ratio of difunctional to trifunctional units is 1:1.5 to 1:2.5 and at least 95% of total number of functional units in the silicone resin are difunctional and trifunctional units, said weight average molecular weight is 7,500 to 10,000 grams/mole, and said alkyl to aryl ratio is 1:0.1 to 1:1.2.

15. A fuser belt of claim 14 wherein said ratio of difunctional to trifunctional units is 1:1.8 to 1:2.3.

16. A fuser belt of claim 14 wherein said alkyl to aryl ratio is 1:0.3 to 1:1.0.

17. A fuser belt of claim 14 wherein said alkyl to aryl ratio is 1:0.4 to 1:0.9.

18. A fuser belt comprising a substrate and a coating on said substrate, said coating comprises a resin made by curing a composition comprising siloxanes having a ratio of difunctional to trifunctional units of 1:1.8 to 1:2.3 and at least 98% of total number of functional units in said siloxanes are difunctional and trifunctional units, a weight average molecular weight of 7,500 to 8,500 grams/mole, and an an alkyl to aryl ratio of 1:0.4 to 1:0.9.

19. A method of fusing comprising the steps of:

passing a receiver bearing toner through the nip formed between a fuser belt and a roller to form a fixed toner image on said receiver, said fuser belt comprising a substrate and a coating on said substrate, said coating comprises a resin made by curing a composition comprising siloxanes having a ratio of difunctional to trifunctional units of 1:1 to 1:2.7 and at least 90% of total number of functional units in said siloxanes are difunctional and trifunctional units, a weight average molecular weight of 5,000 to 50,000 grams/mole, and an alkyl to aryl ratio of 1:0.1 to 1:1.2;

cooling said fuser belt in contact with said fixed toner image on said receiver; and releasing said fixed toner image on said receiver from said fuser belt.

20. The method of fusing of claim 19 wherein said fixed toner image has a G-20 gloss of greater than 80.

* * * * *